US009659485B2

(12) United States Patent
Piccolo, III

(10) Patent No.: US 9,659,485 B2
(45) Date of Patent: May 23, 2017

(54) SELF-TESTING SMOKE DETECTOR WITH INTEGRATED SMOKE SOURCE

(71) Applicant: Tyco Fire & Security GmbH, Neuhausen am Rheinfall (CH)

(72) Inventor: Joseph Piccolo, III, Fitzwilliam, NH (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 319 days.

(21) Appl. No.: 14/259,176

(22) Filed: Apr. 23, 2014

(65) Prior Publication Data

US 2015/0310732 A1 Oct. 29, 2015

(51) Int. Cl.
*G08B 29/14* (2006.01)
*G08B 17/113* (2006.01)

(52) U.S. Cl.
CPC ..... *G08B 29/145* (2013.01); *G08B 17/113* (2013.01)

(58) Field of Classification Search
CPC .. G08B 29/145; G08B 17/113; G01N 33/007; G01N 27/4163; G01N 33/0006; Y10T 436/204998
See application file for complete search history.

(56) References Cited

U.S. PATENT DOCUMENTS 4,099,178 A 7/1978 Ranney et al.
4,595,914 A 6/1986 Siegel
4,623,788 A 11/1986 Kern et al.
4,870,394 A 9/1989 Corl et al.
4,965,556 A 10/1990 Brodecki et al.
5,149,921 A 9/1992 Picado
5,400,014 A 3/1995 Behlke et al.
5,568,129 A 10/1996 Sisselman et al.
5,621,394 A 4/1997 Garrick et al.
5,625,346 A 4/1997 Shim et al.
5,798,701 A 8/1998 Bernal et al.
5,821,866 A 10/1998 Bernal et al.
6,225,910 B1 5/2001 Kadwell et al.
(Continued)

FOREIGN PATENT DOCUMENTS

DE 10 2005 060 748 B3 3/2007
DE 10 2012 215 212 A1 3/2014
(Continued)

OTHER PUBLICATIONS

International Search Report and Written Opinion of the International Searching Authority, mailed on Jul. 17, 2015, from counterpart International Application No. PCT/IB2015/052791, filed on Apr. 16, 2015.
(Continued)

*Primary Examiner* — Sisay Yacob
(74) *Attorney, Agent, or Firm* — HoustonHogle LLP

(57) ABSTRACT

A device and method for self-testing fire detection devices that includes a smoke source housed within the fire detection device. The smoke source is typically a pressurized canister or cartridge, which stores or generates smoke or a smoke equivalent. In response to a signal from a controller, the smoke source releases the smoke or smoke equivalent in or near a sampling volume of the fire detection device to test the operation of the fire detection device. If the device is operating properly, it will be triggered in response to the smoke or a smoke equivalent.

20 Claims, 9 Drawing Sheets

(56) References Cited

U.S. PATENT DOCUMENTS

| | | | | |
|---|---|---|---|---|
| 6,313,744 | B1 | 11/2001 | Capowski et al. | |
| 6,326,897 | B2 | 12/2001 | Kadwell et al. | |
| 6,653,942 | B2 | 11/2003 | Kadwell et al. | |
| 6,737,967 | B2 | 5/2004 | Farley | |
| 6,756,906 | B2 | 6/2004 | Bernal et al. | |
| 6,769,285 | B2 | 8/2004 | Schneider et al. | |
| 6,950,016 | B2 | 9/2005 | Farley | |
| 7,034,702 | B2 | 4/2006 | Thomas et al. | |
| 7,106,187 | B2 | 9/2006 | Penney et al. | |
| 7,158,023 | B2 | 1/2007 | Kaiser | |
| 7,167,088 | B2 | 1/2007 | Farley | |
| 7,167,098 | B2 | 1/2007 | Siber et al. | |
| 7,242,288 | B2 | 7/2007 | Kaiser et al. | |
| 7,463,159 | B2 | 12/2008 | Hess et al. | |
| 7,483,139 | B2 | 1/2009 | Powell | |
| 7,852,227 | B2 | 12/2010 | Pepper et al. | |
| 8,228,182 | B2 | 7/2012 | Orsini et al. | |
| 2002/0128783 | A1 | 9/2002 | Marcu et al. | |
| 2003/0001746 | A1* | 1/2003 | Bernal | G08B 17/107 340/630 |
| 2003/0145644 | A1* | 8/2003 | Rabbett | G01N 33/0006 73/1.06 |
| 2004/0035179 | A1 | 2/2004 | Koch | |
| 2004/0197092 | A1* | 10/2004 | Koch | G01N 33/007 392/399 |
| 2005/0100478 | A1 | 5/2005 | Harvey | |
| 2005/0110631 | A1* | 5/2005 | Siber | G08B 29/145 340/514 |
| 2005/0204799 | A1* | 9/2005 | Koch | G08B 29/145 73/1.06 |
| 2005/0217872 | A1 | 10/2005 | Oh et al. | |
| 2006/0202847 | A1 | 9/2006 | Oppelt et al. | |
| 2012/0286946 | A1 | 11/2012 | Karl et al. | |
| 2013/0093594 | A1 | 4/2013 | Brigham et al. | |

FOREIGN PATENT DOCUMENTS

| | | | |
|---|---|---|---|
| EP | 0 213 383 | A1 | 3/1987 |
| EP | 1224641 | B1 | 8/2000 |
| EP | 1224641 | B1 | 5/2003 |
| EP | 1 580 706 | A1 | 9/2005 |
| GB | 2 408 324 | A | 5/2005 |

OTHER PUBLICATIONS

International Preliminary Report on Patentability, mailed on Nov. 3, 2016, from International Application No. PCT/IB2015/052791, filed on Apr. 16, 2015. Nine pages.

* cited by examiner

SELF-TESTING SMOKE DETECTOR WITH INTEGRATED SMOKE SOURCE

BACKGROUND OF THE INVENTION

Fire alarm systems are often installed within commercial, residential, educational, or governmental buildings, to list a few examples. These fire alarm systems typically include control panels and fire detection devices, which monitor the buildings for indicators of fire (e.g., smoke, fire, rises in temperature). Often, the fire detection devices include individually addressable smoke detectors that are part of a networked fire alarm system. The smoke detectors send event data to the control panel, which analyzes the received event data and generates an alarm if smoke is detected by one or more of the smoke detectors.

In another configuration, the fire alarm system is comprised of standalone or independent smoke detectors. This type of system is often implemented in residential buildings where there is a smaller area to monitor and building code requirements are more lenient. While each detector operates independently from the other detectors of the system, the detectors are often interconnected such that if one detector is activated into an alarm state, then all of the detectors enter the alarm state.

Two common types of fire detection devices are photoelectric (or optical) smoke detectors and ionization smoke detectors. The optical smoke detectors generally include a baffle system, which defines a detection chamber. The baffle system blocks ambient light from an ambient environment while also allowing air or smoke to flow into the detection chamber. A smoke detection system within the detection chamber detects the presence of smoke. Typically, the smoke detection system includes a chamber light source and a scattered light photodetector. When smoke fills the detection chamber it causes the light from the chamber light source to be scattered within the chamber and detected by the scattered light photodetector. Once a predefined amount of light is received by the scattered light photodetector, an alarm condition is generated. The ionization smoke detectors also typically have a detection chamber containing an ionizing radioisotope to ionize the air in the detection chamber. When smoke fills the detection chamber, the electronics of the smoke detector detect a change caused by the ionization of the smoke. In response to the change in current, an alarm condition is generated. While ionization smoke detectors also include a baffle system to protect the detection chamber, the baffle system is typically designed to prevent moisture from entering the detection chamber because it can affect the accuracy of the smoke detector.

Currently, building codes often require that the fire detection devices be tested annually. This annual testing is performed because smoke detectors, for example, have a number of different failure points. For example, the electronics and/or optics of the detector can fail. Alternatively, the baffle systems can become dirty and clogged over time. Additionally, it is not uncommon for the smoke detectors to be painted over or for insects or spiders to build nests or webs in the detectors.

The annual testing for smoke detectors is commonly completed by a technician performing a walkthrough test. The technician walks through the building and manually tests each of the detectors of the fire alarm system. Typically, the technician uses a special testing device. In one example, the testing device includes a smoke generator housed within a hood at the end of a pole. The technician places the hood around the fire detection device and the smoke generator releases artificial smoke near the detector. If the smoke detector is functioning properly, it will trigger in response to the artificial smoke. The technician repeats this process for every smoke detector of the fire alarm system.

Self-testing fire detection devices have been proposed. In one specific example, a self-test circuit for a smoke detector periodically tests whether the sensitivity of a scattered light photodetector is within a predetermined range of acceptable sensitivities. If the sensitivity of the scattered light photodetector is out of the predetermined range, then a fault indication is produced.

SUMMARY OF THE INVENTION

The current method for manually testing smoke detectors of a fire alarm system is labor intensive. The technician must walk through the building and manually test each smoke detector of the fire alarm system. This time consuming method is often disruptive to occupants or employees of the building.

The present device and method are directed to a self-testing fire detection device (e.g., a smoke detector), which includes a smoke source housed within the device. The smoke source is typically a canister or cartridge that stores and/or creates a smoke or smoke equivalent. In response to a signal to initiate the self-test, the smoke source releases the smoke or smoke equivalent in or near a sampling volume of the fire detection device. If the device is operating properly, it will be triggered in response to the smoke or smoke equivalent.

In general, according to one aspect, the invention features a fire detection device with a self-test capability. The fire detection device includes a smoke detection system for detecting smoke or smoke equivalent in a sampling volume and a smoke source for releasing smoke or smoke equivalent into or near the sampling volume. The device further includes a controller that determines whether the sampling volume is in communication with an ambient environment based on detection of the smoke or smoke equivalent by the smoke detection system.

Preferably, the smoke source is housed within the fire detection device. Typically, the smoke source is a pressurized canister or cartridge that releases the smoke or smoke equivalent in response to a signal from the controller. Additionally, the pressurized canister includes a valve system that releases a predetermined quantity of the smoke or smoke equivalent into or near the sampling volume. Ideally, the smoke source contains or has the capacity to generate enough smoke to test the detector for the entire rated lifetime of the detector, assuming testing once or twice per year.

In other examples, the smoke source is another type of source such as a source that creates the smoke via a chemical reaction, for example.

In one embodiment, the controller is a device controller located in the fire detection device. In an alternative embodiment, the controller is a panel controller located in a control panel. In a typical implementation, the controller indicates that the fire detection device needs cleaning and/or replacement in response to determining that the sampling volume is not in communication with the ambient environment.

The controller determines a length of time that is required for the smoke or smoke equivalent to flow into the sampling volume and/or a length of time for the smoke or smoke equivalent to flow out of the sampling volume to assess a degree to which the sampling volume is in communication with the ambient environment.

Alternately, or in addition, the controller calculates a peak amount of smoke or smoke equivalent in the sampling volume to determine a degree to which the sampling volume is in communication with the ambient environment and/or a state of the chamber such as how much dust has accumulated within the chamber.

In one example, the sampling volume is an internal sampling volume that is located within a detection chamber of the fire detection device. In another example, the sampling volume is an external sampling volume that is located outside of the fire detection device.

In general, according to another aspect, the invention features a method for performing a self-test of a fire detection device, which comprises releasing smoke or a smoke equivalent into or near a sampling volume. The smoke or a smoke equivalent is stored in or created by a smoke source, which is housed within the fire detection device. The method further includes detecting the smoke or smoke equivalent in the sampling volume and determining whether the sampling volume is in communication with an ambient environment based on detection of the smoke or smoke equivalent.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1A:
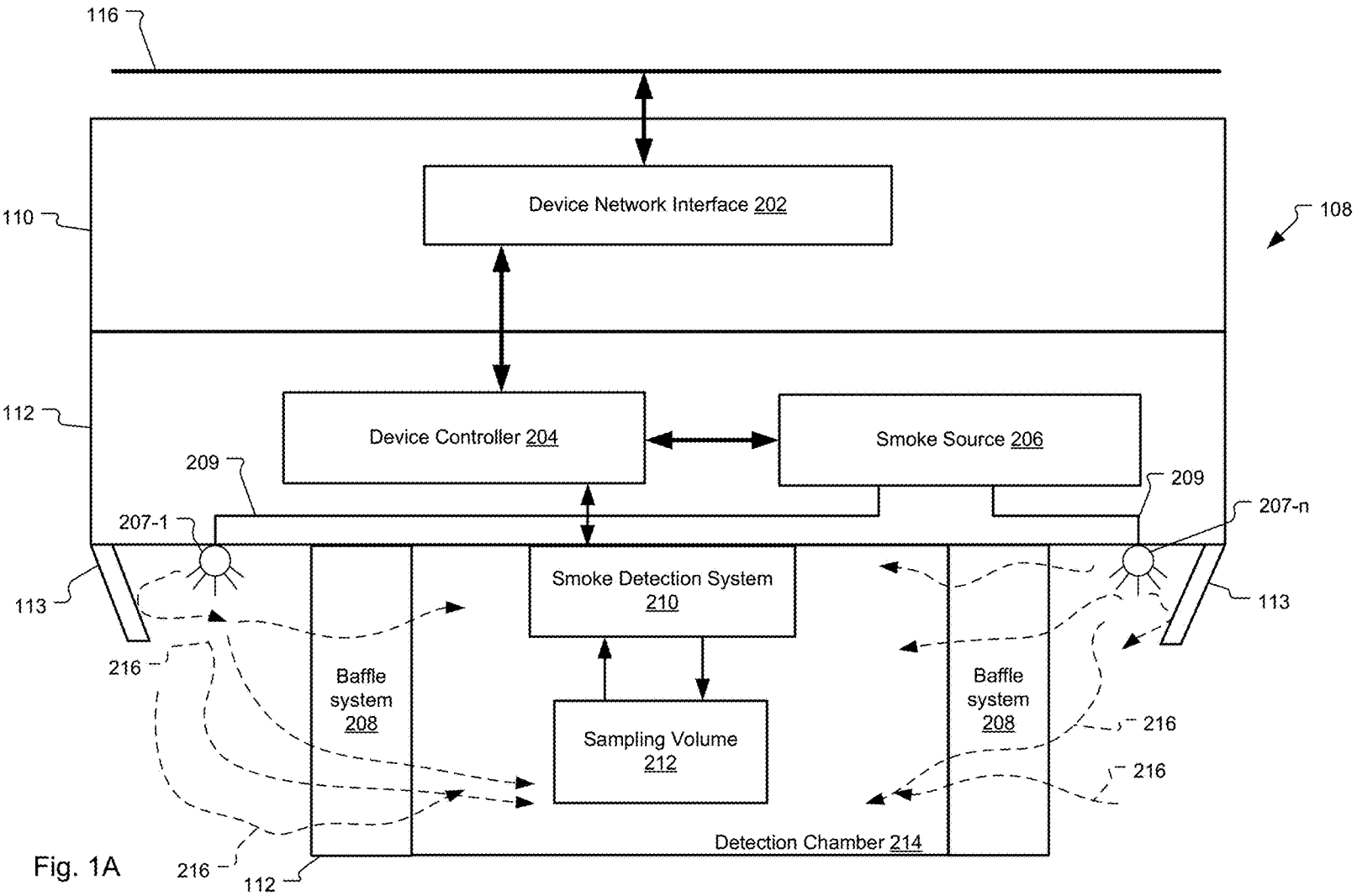
FIG. 1A is a block diagram illustrating a fire detection device, which includes a detection chamber, a smoke source, a smoke detection system, and a baffle system.

FIG. 1A is a block diagram illustrating a fire detection device 108, which includes a detection chamber 214, a smoke source 206, a smoke detection system 210, a baffle system 208, and a device controller 204.

In a typical implementation, the fire detection device 108 includes a housing or body, which is comprised of a base unit 110 and a head unit 112. These components are typically made from molded plastic. Typically, the head unit 112 connects to the base unit 110, which is fastened to a wall or ceiling of a building.

The base unit includes a device interconnect interface 202, which enables the fire detection device 108 to communicate via a safety and security interconnect 116. Generally, the safety and security interconnect 116 supports data and/or analog communication between the device 108 and a control panel.

The head unit 112 generally houses the device controller 204, the smoke detection system 210, and the smoke source 206. The device controller 204 receives information from the smoke detection system 210 and generates analog values based levels of smoke or smoke equivalent 216 detected by the smoke detection system 210. Additionally, in response to a signal received from the control panel, the device controller 204 sends a signal to the smoke source 206 to release smoke 216.

Upon receiving the signal from the device controller 204, a valve or valve system of the smoke source is actuated to release the smoke or smoke equivalent. In a typical implementation, the value system is electronically and/or pneumatically actuated. The smoke or smoke equivalent 216 is typically an artificial or synthetic smoke that mimics the optical and/or electrical properties of real smoke, but is not harmful to occupants.

In the illustrated example, one or more conduits 209 connect to the smoke source 206 and convey the smoke or smoke equivalent to ports 207-1 to **207-*n* arranged about the perimeter of the baffle system 208. Preferably, the ports 207-1 to 207-*n* direct the smoke toward the baffle system 208 and detection chamber 214. In the illustrated example, the head unit 112 further includes a ridge 113, which is installed about the perimeter of the head unit 112 to prevent the smoke or smoke equivalent 216 from flowing away from the fire detection device 108**.

The baffle system 208 defines the detection chamber 214, which houses the sampling volume 212. Additionally, the baffle system 208 blocks out ambient light from the ambient environment while allowing air and smoke to flow to the sampling volume 212.

The smoke detection system 210 detects the smoke or smoke equivalent 216 in the sampling volume 212. In one embodiment, the smoke detection system 210 is an optical detection system, but alternative embodiments could implement ionization or air sampling detection systems, for example. In any event, the system is able to determine whether the detection chamber and specifically the sampling volume is in communication with an ambient environment based on detection of the smoke or smoke equivalent by the smoke detection system after the release of the smoke or smoke equivalent.

Figure 1B:
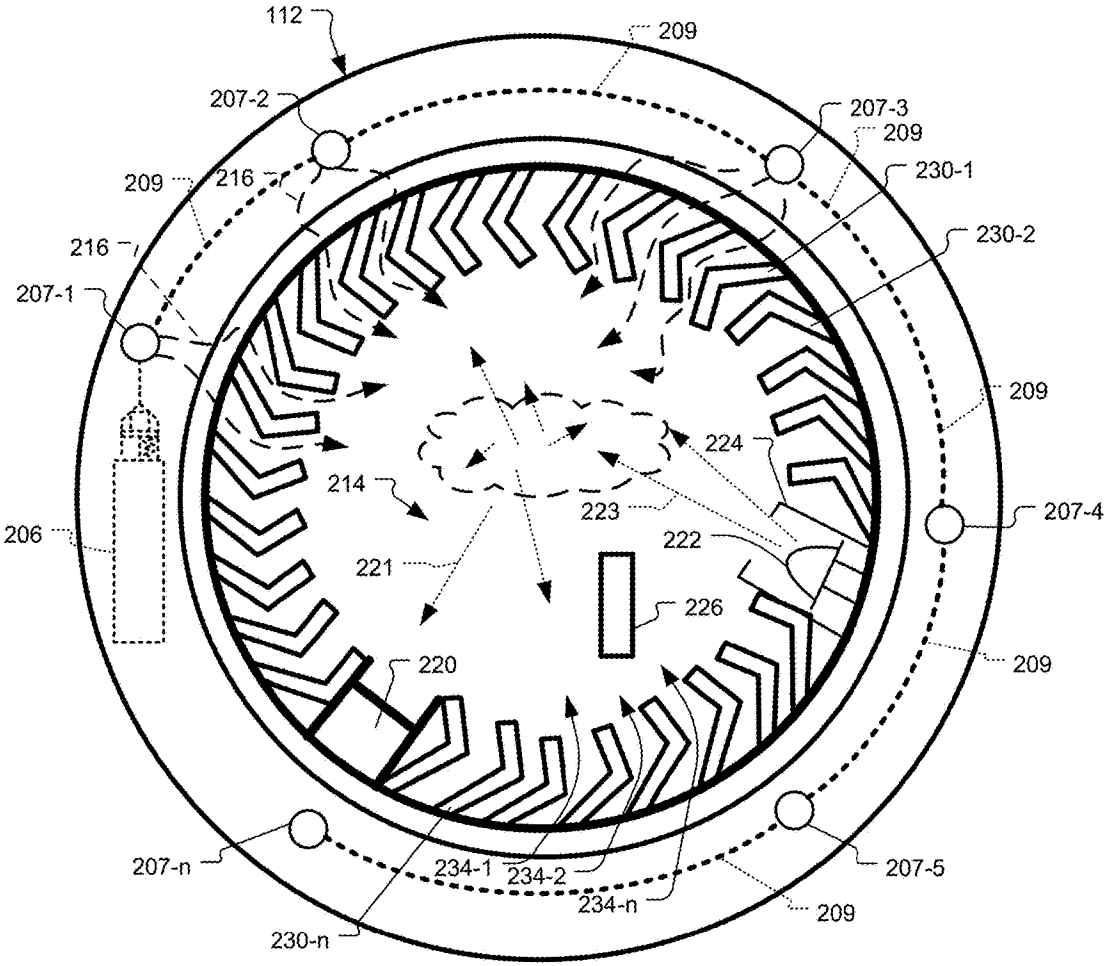
FIG. 1B is a cross-sectional view that further illustrates the detection chamber, the smoke source, the smoke detection system, and the baffle system.

FIG. 1B is a cross-sectional view that illustrates the detection chamber, the smoke detection system, and the baffle system of one embodiment of the fire detection device.

In this embodiment, the detection chamber 214 is defined by individual baffles 230-1 to **230-*n*. The arrangement of the baffles 230-1 to 230-*n* form pathways 234-1 to 234-*n* that allow air and possibly environmental smoke but also the smoke or smoke equivalent 216 to flow into the detection chamber 214**. The baffles are also commonly referred to as channels, vanes, walls, or labyrinths, to list a few examples.

In the illustrated example, the smoke source 206 is connected to the ports 207-1 to **107-*n* via the conduits 209. While the illustrated example shows six ports, alternative embodiments could implement greater or fewer numbers of ports. In a typical implementation, the ports 207-1 to 207-*n* are installed around the perimeter of the baffle system to create an even distribution of the smoke or smoke equivalent 216** about the baffle system.

The smoke detection system 210 detects the presence of smoke within the sampling volume 212 of the detection chamber 214. In the illustrated example, the smoke detection system 210 comprises a chamber light source 222 for generating light 223 and a scattered light photodetector 220 for detecting light that has been scattered due to the smoke or smoke equivalent collecting within the detection chamber 214. Light 223 is directed into the detection chamber 214 through an aperture 224. If smoke is present in the detection chamber 214, the light 223 is scattered by the smoke or smoke equivalent and detected by the scattered light photodetector 220. A blocking baffle 226 is installed within the detection chamber 214 to prevent the light 223 from having a direct path to the scattered light photodetector 220. Thus, in this way, the signal detected by the photodetector is indicative of the concentration of an optically scattering medium, such as smoke, within the sampling volume.

Figure 2A:
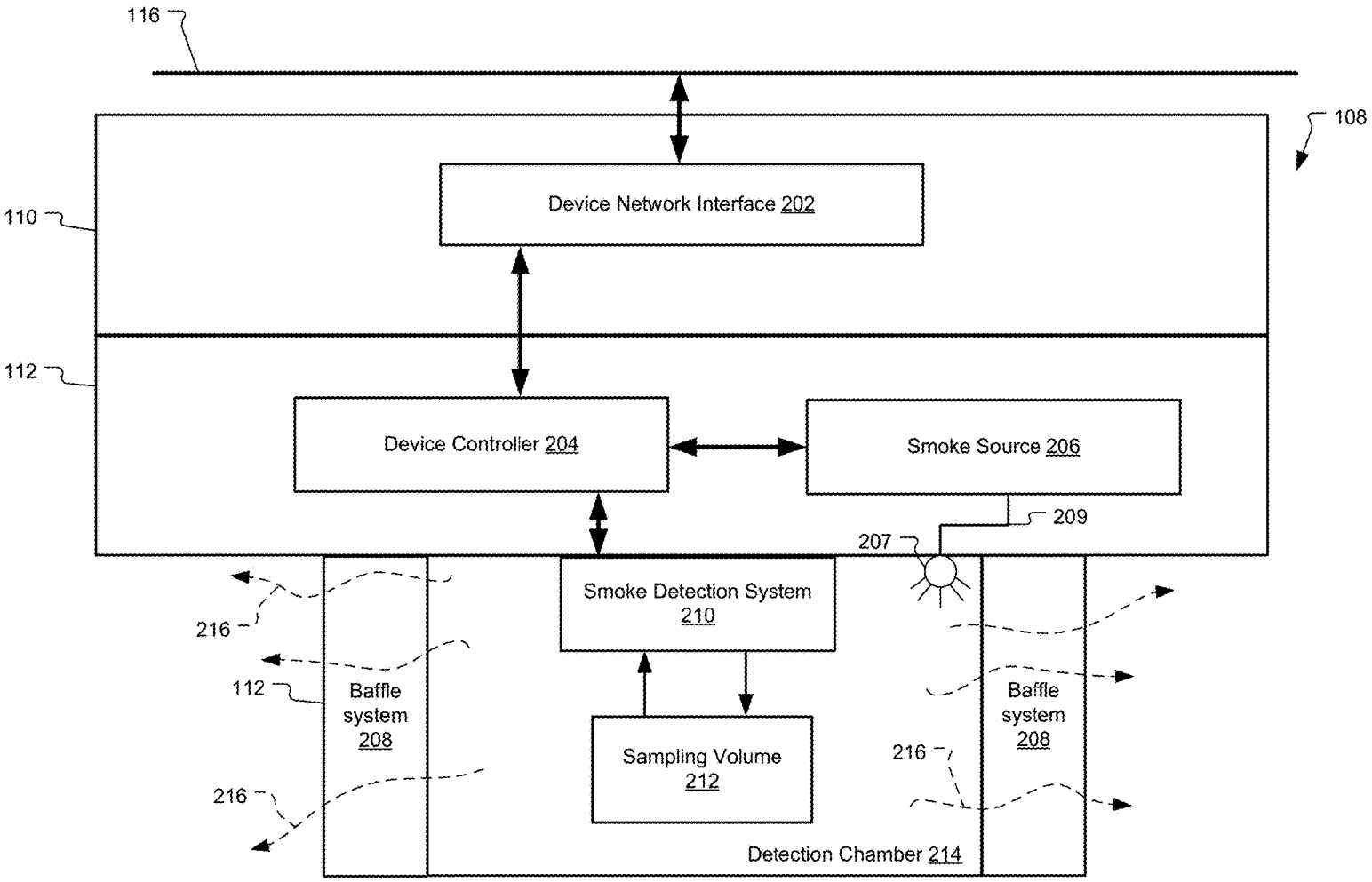
FIG. 2A is a block diagram illustrating an alternative embodiment of the fire detection device, which releases smoke or smoke equivalent directly into the detection chamber of the fire detection device.
Figure 2B:
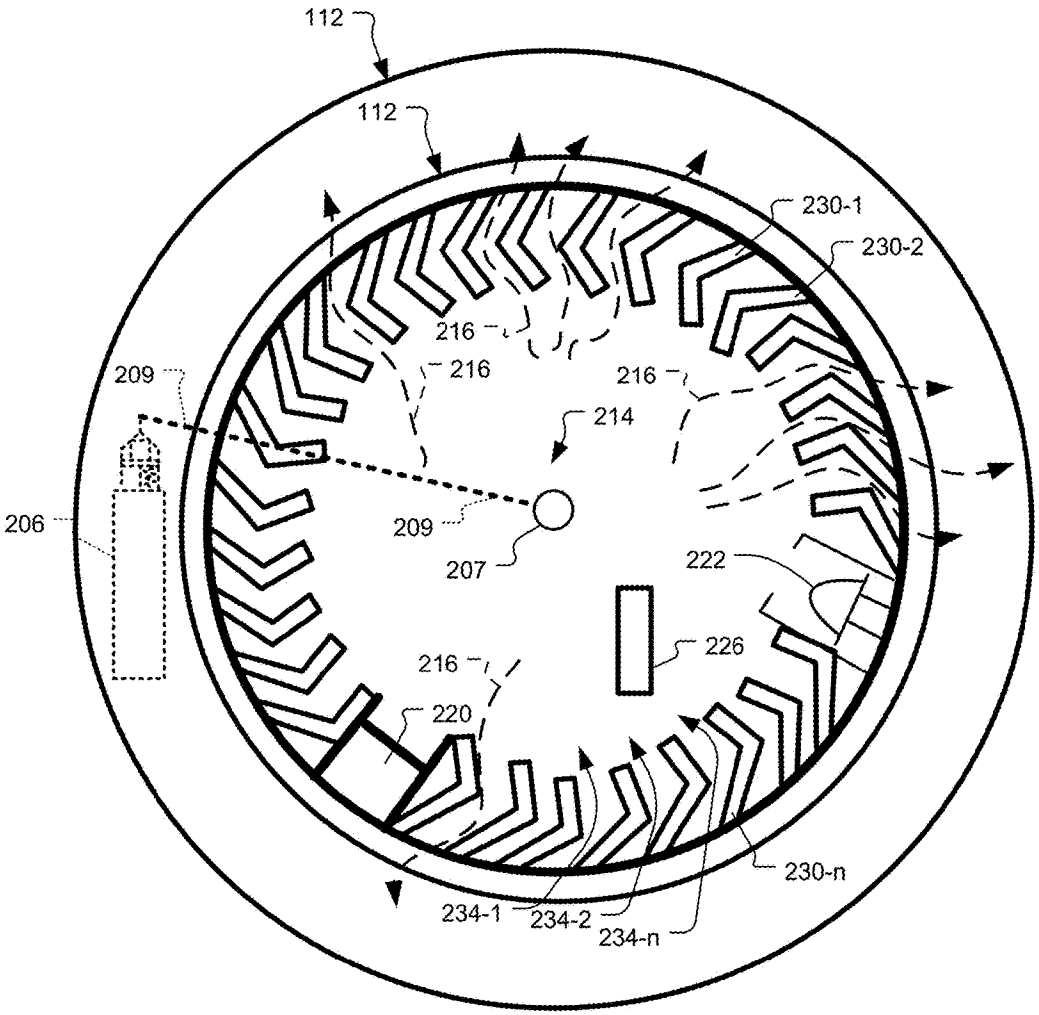
FIG. 2B is a cross-sectional view that further illustrates a smoke source that releases smoke within the detection chamber of the fire detection device.

FIGS. 2A and 2B illustrate an alternative embodiment of the fire detection device 108. In this embodiment, the smoke or smoke equivalent is released directly into the detection chamber 214 of the fire detection device 108.

In general, FIG. 2A is nearly identical to the embodiment described with respect to FIG. 1A. In this embodiment, however, the conduit 209 is routed from the smoke source 206 to the detection chamber 214 to release the smoke or smoke equivalent 216 directly into the sampling volume 212 of the detection chamber 214.

In one mode of operation, rather than detecting the smoke or smoke equivalent and it flows into the detection chamber 214, the smoke detection system 210 and device controller 204 determine if the smoke or smoke equivalent 216 is able to flow out of the detection chamber 214 to thereby assess the degree to which the chamber 214 is in communication with an ambient environment.

FIG. 2B is a cross-sectional view that further illustrates how the smoke source 206 releases the smoke or smoke equivalent into the sampling volume 212 of the detection chamber 214.

In the illustrated example, the smoke or smoke equivalent is released out of the port 207, which is located in the detection chamber 214. If the baffle system is free from obstructions, then the smoke is able to flow out of the pathways.

Figure 3:
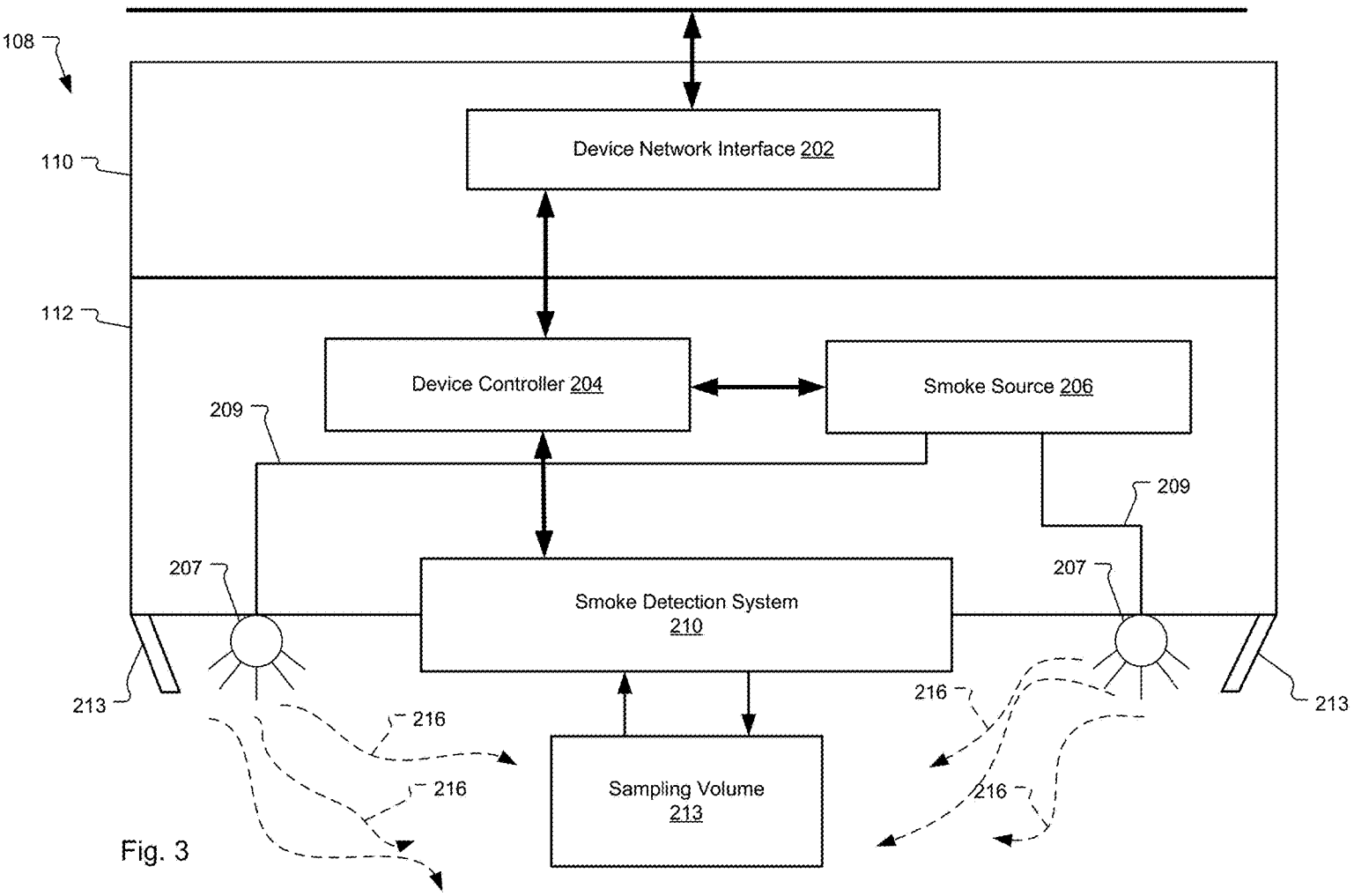
FIG. 3 is a block diagram illustrating a chamberless fire detection device that detects smoke in an external sampling volume located outside of the fire detection device.

FIG. 3 is a block diagram illustrating a "chamberless" fire detection device that detects smoke or smoke equivalent 216 in an external sampling volume 213 located outside of the fire detection device 108.

Unlike the previous embodiments that implemented baffle systems and included a detection chamber, the smoke detection system 210 of illustrated embodiment monitors an external sampling volume 213 that is located outside of the fire detection device.

In a typical implementation, the light source and photodetector of the smoke detection system 210 are installed within the head unit 112 of the fire detection device 108. Light from a light source is projected into the external sampling volume 213. If smoke is present in the external sampling volume 213, the light will be scattered and detected by a photodetector within the head unit 112.

As in the previous embodiments, the smoke source 206 is provided within the housing to release the smoke or smoke equivalent near the sampling volume 213 via ports 207. In one example, the ports are arranged around the sampling volume 213 on the underside of the head 112.

Figure 4:
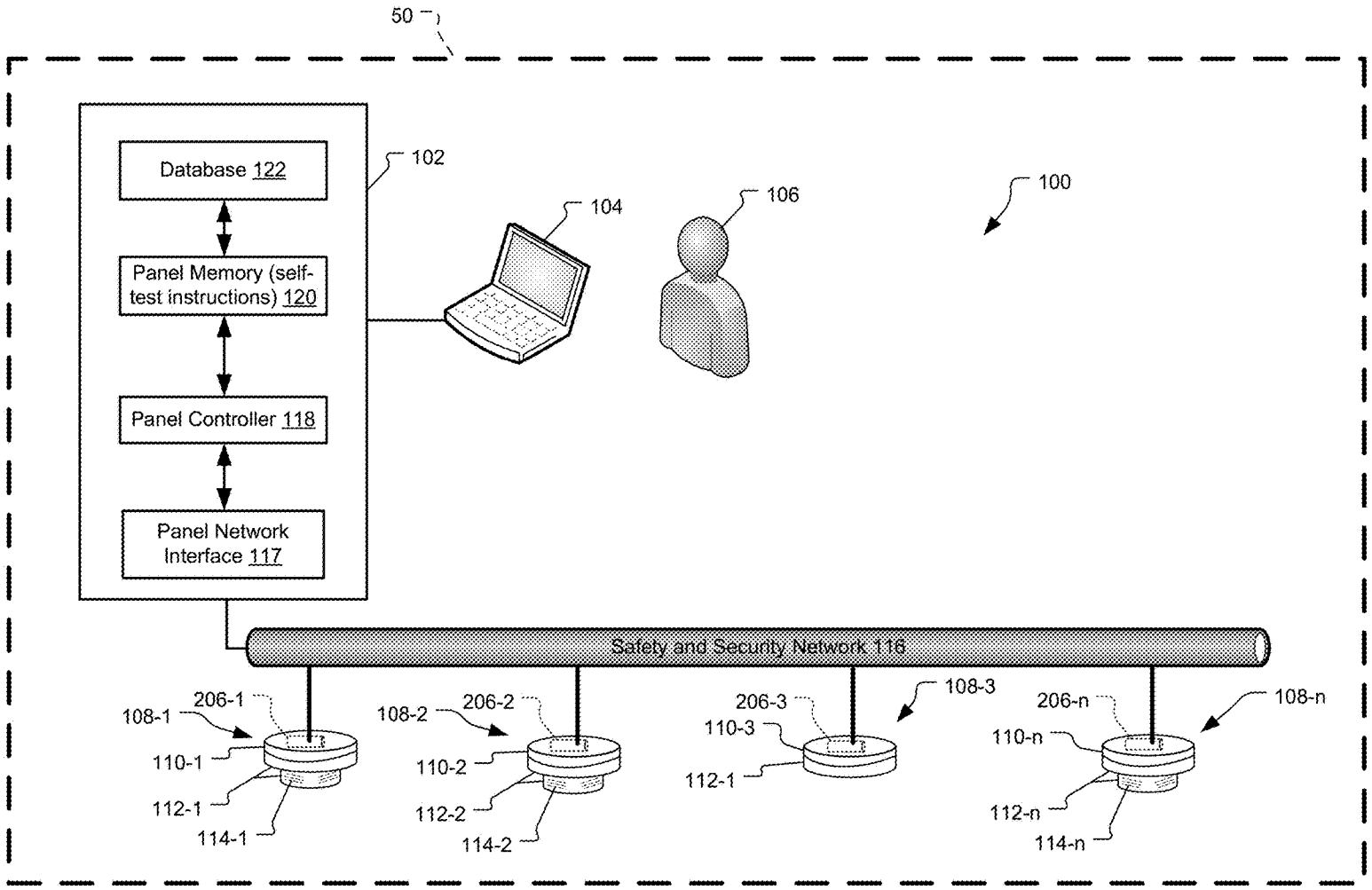
FIG. 4 is a block diagram illustrating a networked fire alarm system, which includes a control panel and fire detection devices that communicate over an interconnect.

FIG. 4 is a block diagram illustrating a fire alarm system 100, which includes the control panel 102, fire detection devices 108-1 to **108-*n*, and an interconnect 116**.

Typically, the fire alarm system 100 is installed within a building 50. Some examples of buildings include hospitals, warehouses, retail establishments, malls, schools, or casinos, to list a few examples. While not shown in the illustrated example, the fire alarm system typically includes other fire detection or annunciation devices such as carbon monoxide or carbon dioxide detectors, temperature sensors, pull stations, speakers/horns, and strobes, to list a few examples.

The control panel 102 includes a panel interconnect interface 117, which enables the control panel 102 to communicate with the fire detection devices 108-1 to **108-*n* via the safety and security interconnect 116. The control panel 102 receives event data from the fire detection devices 108-1 to 108-*n* of the alarm system 100**. Typically, the event data include a physical address of the activated device, a date and time of the activation, and at least one analog value directed to smoke levels or ambient temperature detected by the fire detection device.

While the self-test is typically initiated by a technician 106, the self-test may also be initiated by the control panel 102. In this case, the self-test instructions are stored in panel memory 120. Upon receiving a test signal, the devices 108-1 to **108-*n* initiate self-tests. The devices generate event data, which are sent to the control panel 102 via the safety and security interconnect 116**.

The event data are then stored in the panel memory 120 and/or a database 122 of the control panel 102. Additionally, the event data are also sent to a testing computer 104, where the event data are stored in a log file. A technician 106 is then able to review the log file and/or generate reports, for example. In this way, the panel controller is able to assess the results of the self test and determine whether the sampling volumes of the devices are in communication with their respective ambient environments based on detection of the smoke or smoke equivalent by the smoke detection systems.

Figure 5:
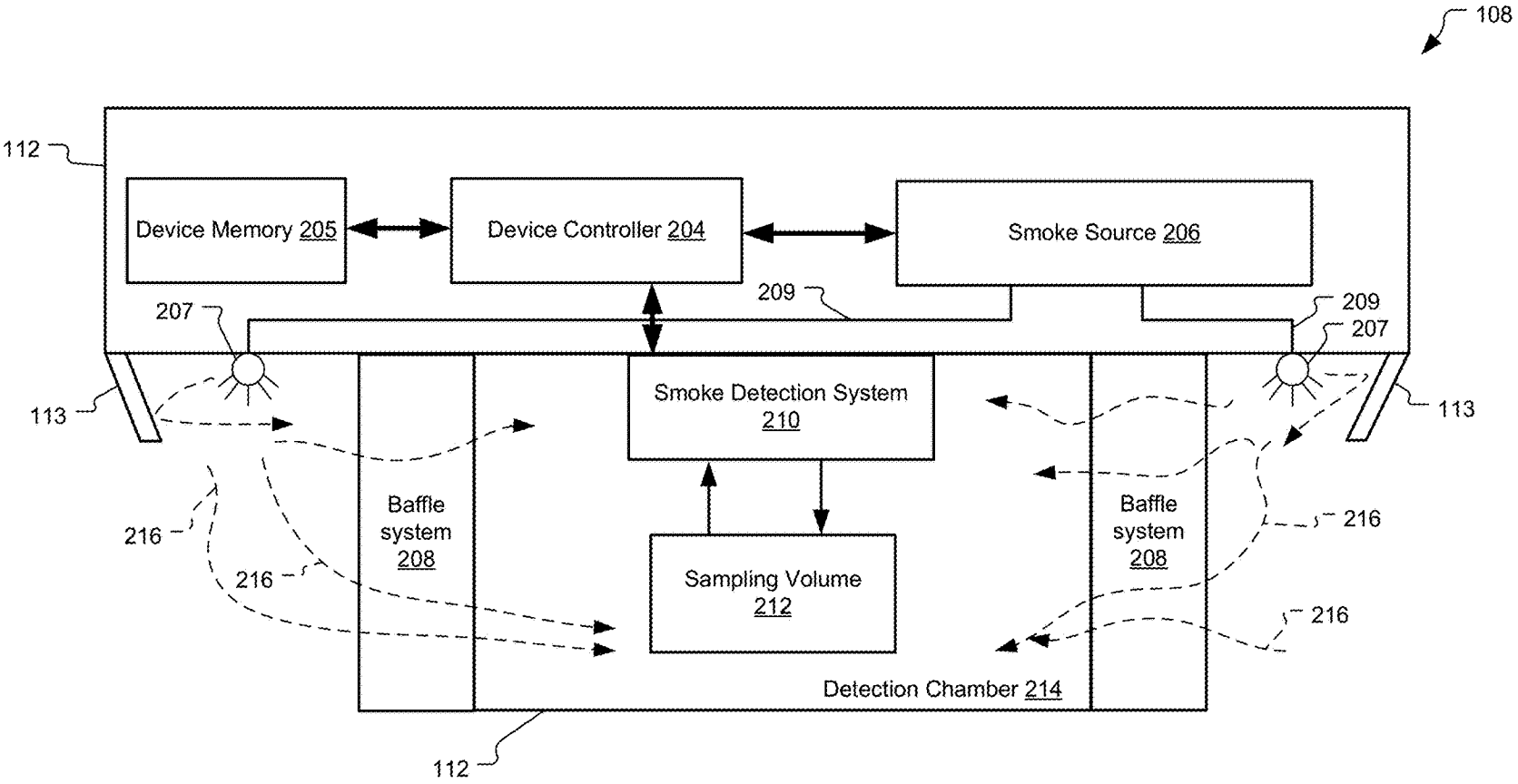
FIG. 5 is a block diagram illustrating a standalone or independent fire detection device.

FIG. 5 is a block diagram illustrating the head unit 112 of a standalone fire detection device 108. That is, the device operates independently from other fire detection devices and independently determines when to initiate the self-test. Alternatively, the fire detection device may include a test button, which enables the technician 106 to initiate the self-test of the device.

Periodically, the device controller 204 accesses self-test instructions stored in the device memory 205 to initiate the self-test. Rather than sending the event data to the control panel 102, the device controller 204 determines whether the sampling volume 212 is in communication with an ambient environment based on detection of the smoke or smoke equivalent by the smoke detection system 210.

Figure 6:
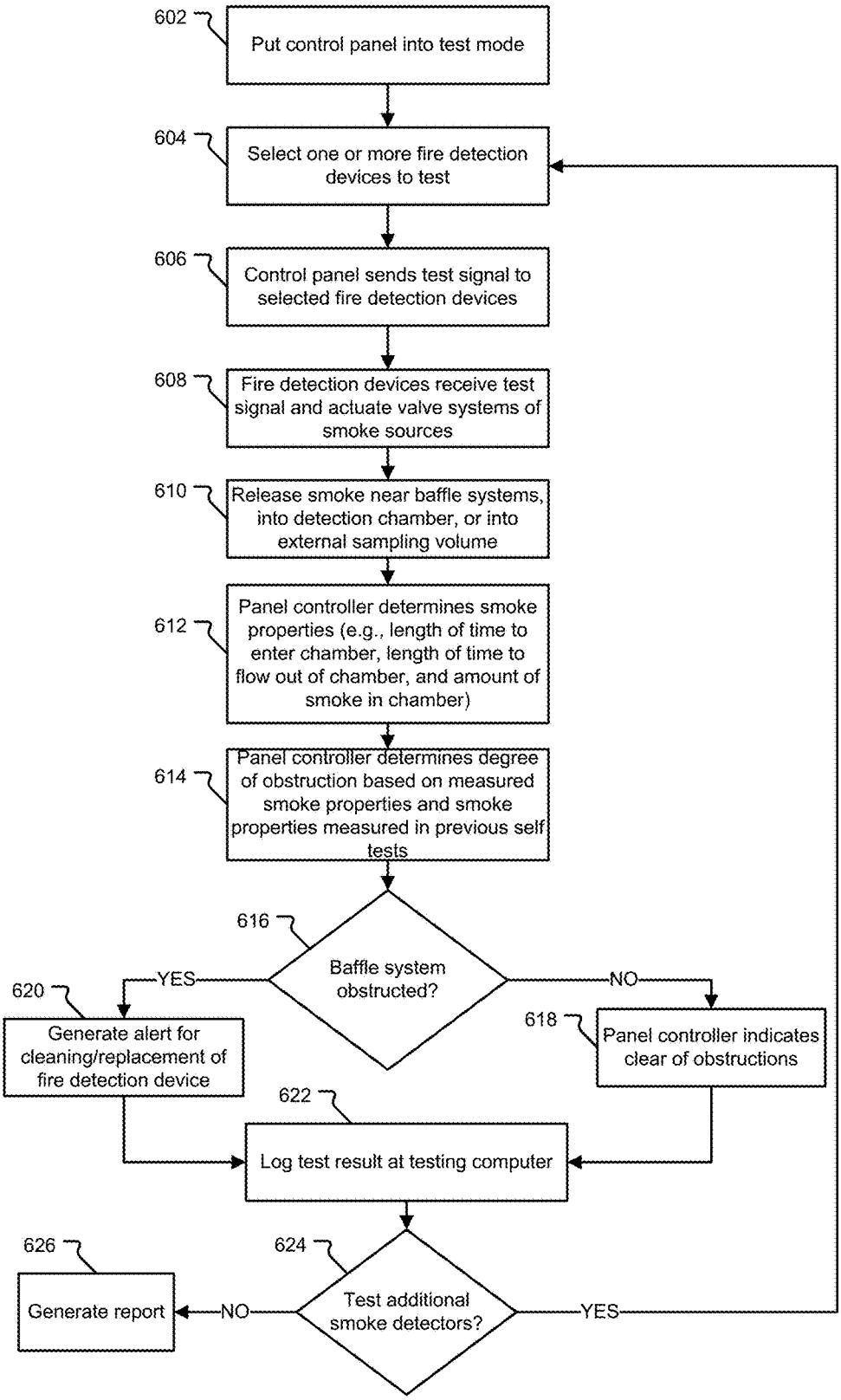
FIG. 6 is a flowchart illustrating the steps performed by the control panel and fire detection device during a self-test.

FIG. 6 is a flowchart illustrating an example in which the control panel 102 initiates the self-test of the fire detection devices.

In the first step 602, the control panel 102 is put into test mode. Typically, the test mode silences and/or deactivates any audio and visual alarms/warnings of the fire detection devices during the test.

In the next step 604, the technician 106 (or control panel) selects one or more fire detection devices to test. Next, the control panel 102 sends a test signal to the selected fire detection devices in step 606.

The selected fire detection devices receive the test signal and actuate valve systems of smoke sources or otherwise generate the smoke or smoke equivalent, such as via a chemical reaction, in step 608. The smoke sources release the smoke or smoke equivalent near the baffle systems, into the detection chambers, or into external sampling volumes of the fire detection devices in step 610.

The smoke or smoke equivalent is detected by the smoke detection system and the panel controller determines properties of the smoke or smoke equivalent, such as its density within the sampling volume, to assess a degree to which the sampling volume is in communication with the ambient environment in step 612. In one example, the panel controller determines a length of time for the smoke or smoke equivalent to flow into the sampling volume and/or a length of time for the smoke or smoke equivalent to flow out of the sampling volume. In an alternative embodiment, the panel controller determines an amount, as a peak amount, of smoke or smoke equivalent that is detected within the sampling volume in order to assess a degree to which the chamber, for example, is filled with dust.

In the next step 614, the panel controller 118 determines a degree of obstruction based on the measured smoke properties of the current test and the smoke properties measured in previous self-tests or as part of an original factory calibration.

Next, the panel controller determines if the baffle system is obstructed in step 616 based on this analysis.

If the baffle system is obstructed, then the panel controller 118 generates an alert for cleaning/replacement of fire detection device in step 620. If, however, the baffle system is not obstructed, then the panel controller indicates that the fire detection device is free from obstructions in step 618. The results of the test are then logged at the testing computer 104 in step 622. Alternatively, the test results may also be stored in the panel memory 120 of the control panel 102. In this scenario, the control panel 102 would store the results of the recent tests to enable the technician, a fire inspector, or a building manager to access the previous test results.

If there are no additional fire detection devices to test (step 624), then a report is generated in step 626. If additional fire detection devices need to be tested, then one or more fire detection devices are selected in step 604.

Figure 7:
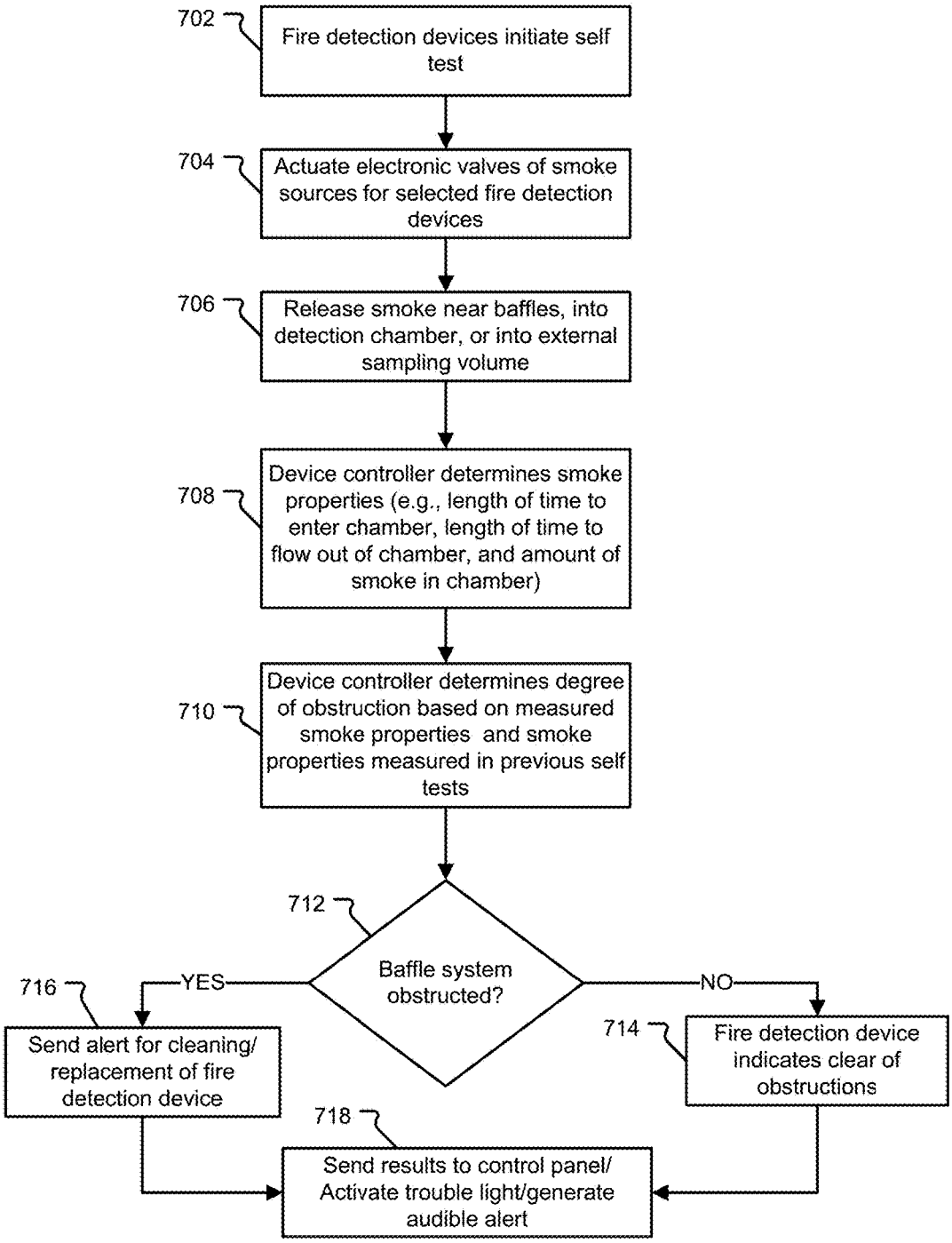
FIG. 7 is a flowchart illustrating the steps performed by the fire detection device when the fire detection device operates independently.

FIG. 7 is a flowchart illustrating an example in which the fire detection devices operate independently and self-initiate the tests.

In the first step 702, the fire detection device initiates a self-test. The fire detection device then actuates electronically controlled valves of smoke sources or triggers a chemical reaction to generate the smoke or smoke equivalent in step 704. Next, the smoke source releases the smoke or smoke equivalent near the baffle systems, into the detection chambers, or into external sampling volumes of the fire detection devices in step 706.

The smoke or smoke equivalent is detected by the smoke detection system and the device controller determines properties of the smoke or smoke equivalent to assess a degree to which the sampling volume is in communication with the ambient environment in step 708.

In the next step 710, the device controller 118 determines a degree of obstruction based on the measured smoke properties and the smoke properties measured in previous self-tests. Next, the device controller determines if the baffle system is obstructed in step 712.

If the baffle system is obstructed, then the panel controller generates an alert for cleaning/replacement of fire detection device in step 716. If, however, the baffle system is not obstructed, then the fire detection device indicates that the fire detection device is free from obstructions in step 714.

In the next step 718, the fire detection device sends the results of the test to any control panel, activates a trouble light, and/or generates audible alerts.

While this invention has been particularly shown and described with references to preferred embodiments thereof, it will be understood by those skilled in the art that various changes in form and details may be made therein without departing from the scope of the invention encompassed by the appended claims.

What is claimed is:

1. A fire detection device with a self-test capability, the device comprising:

a baffle system defining a detection chamber, which houses a sampling volume, the baffle system blocking out ambient light from the ambient environment while allowing air and smoke to flow to the sampling volume;

a smoke detection system for detecting smoke or smoke equivalent in the sampling volume, wherein the smoke detection system comprises a light source and a photodetector for detecting light from the light source, which is indicative of an optical scattering medium in the sampling volume;

a smoke source for releasing smoke or smoke equivalent into or near the sampling volume, the smoke source being housed within the fire detection device; and a controller for determining whether the sampling volume is in communication with an ambient environment based on detection of the smoke or smoke equivalent by the smoke detection system.

2. The device according to claim 1, wherein the photodetector is a scattered light photodetector for detecting light that has been scattered due to the smoke or smoke equivalent in the sampling volume.

3. The device according to claim 1, wherein the smoke source is a pressurized canister that releases the smoke or smoke equivalent in response to a signal received from the controller.

4. The device according to claim 3, wherein the pressurized canister includes a valve system that releases a predetermined quantity of the smoke or smoke equivalent into or near the sampling volume.

5. The device according to claim 3, wherein the controller is a device controller located in the fire detection device.

6. The device according to claim 3, wherein the controller is a panel controller located in a control panel.

7. The device according to claim 1, wherein the controller indicates that the fire detection device needs cleaning and/or replacement in response to determining that the sampling volume is not in communication with the ambient environment.

8. The device according to claim 1, wherein the controller determines a length of time for the smoke or smoke equivalent to flow into the sampling volume and/or a length of time for the smoke or smoke equivalent to flow out of the sampling volume to assess a degree to which the sampling volume is in communication with the ambient environment.

9. The device according to claim 1, wherein the controller calculates a peak amount of smoke or smoke equivalent in the sampling volume to determine a degree to which the sampling volume is in communication with the ambient environment.

10. The device according to claim 1, wherein the sampling volume is an internal sampling volume that is located within a detection chamber of the fire detection device.

11. The device according to claim 1, wherein the sampling volume is an external sampling volume that is located outside of the fire detection device.

12. A method for performing a self-test of a fire detection device, the method comprising:

releasing smoke or a smoke equivalent into or near a sampling volume, the smoke or a smoke equivalent being stored in a smoke source that is housed within the fire detection device, wherein a baffle system defines a detection chamber, which houses the sampling volume, the baffle system blocking out ambient light from the ambient environment while allowing air and smoke to flow to the sampling volume;

detecting the smoke or smoke equivalent in the sampling volume using a light source and a photodetector for detecting light from the light source, which is indicative of an optical scattering medium in the sampling volume;

detecting the smoke or smoke equivalent in the sampling volume; and determining whether the sampling volume is in communication with an ambient environment based on detection of the smoke or smoke equivalent.

13. The method according to claim 12, further comprising indicating that the fire detection device needs cleaning and/or replacement in response to a determination that the sampling volume is not in communication with the ambient environment.

14. The method according to claim 12, further comprising determining a length of time for the smoke or smoke equivalent to flow into the sampling volume and/or a length of time for the smoke or smoke equivalent to flow out of the sampling volume to assess a degree to which the sampling volume is in communication with the ambient environment.

15. The method according to claim 12, wherein determining whether the sampling volume is in communication with the ambient environment comprises determining a peak amount of smoke or smoke equivalent.

16. The method according to claim 12, further comprising releasing the smoke or smoke equivalent in response to a signal from a device controller or a panel controller.

17. The method according to claim 12, wherein the smoke source is a pressurized canister or cartridge.

18. The method according to claim 17, wherein releasing the smoke or smoke equivalent comprises releasing the smoke or smoke equivalent from a pressurized canister or cartridge via a valve system.

19. The method according to claim 12, wherein releasing the smoke or smoke equivalent comprises releasing the smoke or smoke equivalent near or within a detection chamber of the fire detection device that defines the sampling volume.

20. The method according to claim 12, wherein releasing the smoke or smoke equivalent comprises releasing the smoke or smoke equivalent adjacent to the fire detection device for an external sampling volume.

* * * * *